US008896217B2

(12) United States Patent
Perazella

(10) Patent No.: US 8,896,217 B2
(45) Date of Patent: Nov. 25, 2014

(54) LIGHT SOCKET FOR SERIES LED LIGHTING

(71) Applicant: Thomas Perazella, North Potomac, MD (US)

(72) Inventor: Thomas Perazella, North Potomac, MD (US)

( * ) Notice: Subject to any disclaimer, the term of this patent is extended or adjusted under 35 U.S.C. 154(b) by 127 days.

(21) Appl. No.: 13/739,149

(22) Filed: Jan. 11, 2013

(65) Prior Publication Data

US 2014/0197738 A1 Jul. 17, 2014

Related U.S. Application Data

(60) Provisional application No. 61/593,568, filed on Feb. 1, 2012.

(51) Int. Cl.
*H05B 37/00* (2006.01)
*H05B 37/03* (2006.01)

(52) U.S. Cl.
CPC ..... *H05B 37/036* (2013.01)
USPC ..... 315/185 R; 315/119; 315/122

(58) Field of Classification Search
USPC ..... 315/185 R, 192, 119, 123, 121, 122
See application file for complete search history.

(56) References Cited

U.S. PATENT DOCUMENTS

2008/0024071 A1* 1/2008 Yu ..... 315/192

* cited by examiner

*Primary Examiner* — David H Vu
(74) *Attorney, Agent, or Firm* — White-Welker & Welker, LLC; Matthew T. Welker, Esq.

(57) ABSTRACT

Electrical and mechanical connection for a series connected LED lamp to an appropriate electrical circuit. The circuit contains additional series connected light producing elements. To enable continuous operation of all the other light producing elements in the series circuit, the socket contains a device to bypass the series current to the remaining circuit elements in the case of a defective lamp or connection. Operation of the bypass device is controlled within the socket with operational parameters controlled either from within the socket or in conjunction with an external element in the lamp. The operation of the bypass circuit is latching, once operating the bypass will continue to operate until reset preventing unwanted flicker in the case of intermittent connections. The method of resetting the bypass circuit may be either manual or automatic. The socket bypass may contain a time delay to allow internal bypass circuits included within the lamp to operate before the socket bypass activates.

19 Claims, 6 Drawing Sheets

LIGHT SOCKET FOR SERIES LED LIGHTING

CROSS REFERENCE TO RELATED APPLICATIONS

This application claims priority from U.S. patent application Ser. No. 61/593,568, entitled "Light Socket for Series LED Lighting", filed on 1 Feb. 2012. The benefit under 35 USC §119(e) of the United States provisional application is hereby claimed, and the aforementioned application is hereby incorporated herein by reference.

FEDERALLY SPONSORED RESEARCH

Not Applicable

SEQUENCE LISTING OR PROGRAM

Not Applicable

TECHNICAL FIELD OF THE INVENTION

The present invention relates generally to LED lighting. More specifically, the present invention relates to an LED light socket for achieving the maximum efficiency, reliability and cost effectiveness when using LED lighting.

BACKGROUND OF THE INVENTION

The most common source of electrical lighting has been the incandescent filament lamp because of several beneficial characteristics: Low manufacturing cost; Availability in a wide variety of light outputs; Availability in a wide variety of operating voltages for direct operation from various power sources with no intervening power supply; Operation across wide ranges of ambient temperatures; Easily adjustable light output using low cost electronic dimmers; Generally no or very limited flicker in output at commercially utilized power line frequencies; and Relatively benign disposal characteristics. Within reasonable ranges, various output lamps can be used in the same fixture providing user capable lighting flexibility. Operation of lamps is independent of whether power source is AC or DC. Relatively benign operating characteristics present an easy load to power sources. Continuous spectrum output results in a High Color Rendering Index (CRI) for accurate color reproduction of illuminated objects.

The incandescent lamp has substantial limitations that are increasing pressure to migrate to other technologies including: Relatively low conversion of input power to light output commonly referred to as lumens per watt; The energy cost of the lamp over its life outweighs the low cost of the lamp; High heat production in relationship to light output; Most lamps present a burn risk if they are handled while operating; Relatively fragile to shock; Change in color temperature with change in input voltage; Relatively short life for lamps with even reasonable light output; and Very short life for overvoltage conditions. Lamp life decreases with the $12^{th}$ power of voltage. For normal lamps light output drops with age as the filament material transfers to the envelope. Lamps with longer life such as tungsten halogen have high starting current and operate at high pressures presenting an explosion hazard. Tungsten halogen lamps require special handling to prevent damage by contaminants while lamping.

Other technologies have been investigated and used for light production with the primary goal to increase efficiency. The most common include fluorescent lamps, and high and low pressure gas discharge lamps including metal additive types and most recently Light Emitting Diodes (LED). Of the alternative technologies, fluorescent lighting has seen the widest acceptance in general residential and industrial lighting. Advantages of this technology include: Higher efficiency; Relatively long life; and Relatively low lamp cost. Disadvantages of fluorescent lighting include: Lamps cannot be operated directly off common power sources without intervening power supplies (ballasts); Dimming cannot be done with common low cost dimmers; Some degree of flicker exists at normal line frequencies; Common ballasts waste power and can cause noise; More efficient high frequency ballasts are more expensive; Cold weather performance is poor without special lamps and ballasts; The lamps are very fragile; Except for very expensive lamps, the CRI is only fair; and Most lamps have a warm up time to reach full light output. Lamps contain mercury and phosphors which are hazardous materials and require special disposal to prevent environmental problems.

Attempts to directly replace incandescent lamps in the existing incandescent fixtures with Compact Fluorescent Lamps (CFL) are only partially successful because each lamp requires individual ballast and may be too large to fit the fixture. These lamps have severely shortened life if dimming is attempted and the efficiency is lower than permanent fluorescent fixtures with more sophisticated ballasts. Their cost is high because each lamp must have a dedicated ballast. When the lamp fails, the ballast is discarded along with the lamp.

Although still a relative newcomer to lighting technology, the LED has the greatest potential to become the standard type of light source for the majority of residential and commercial lighting applications. The characteristics that make the LED a strong contender include: Very high conversion efficiency of electricity to light; Very long life; Immunity to most shock and other physical hazards; Relatively cool operation; CRI that is better than other high efficiency types; Constant color temperature with dimming; Immediate light output with no warm up time; and Low up front cost if properly implemented.

The disadvantages of LED light sources include: Cannot be used directly off existing power lines; DC only operation requires some form of conversion of AC supplies to DC; Generally require current limiting as they are more a current responsive device than voltage responsive; and they work more efficiently in series configurations rather than parallel which is the norm for existing lighting setups. Series operation has the problem that if one segment of the series string fails, the whole string fails.

Current attempts to use LED lighting in existing lighting fixtures requires that each lamp have a built in power supply which adds considerable cost and size, reduces efficiency and like CFL lamps is discarded when the lamp is replaced. Operation with existing simple solid state dimmers may not be possible or satisfactory.

SUMMARY OF THE INVENTION

The present invention is a light socket for series LED lighting. This device provides an electrical and may also provide a mechanical connection for a series connected LED lamp to an appropriate electrical circuit. The circuit will also contain additional series connected light producing elements.

To enable continuous operation of all the other light producing elements in the series circuit, the socket contains a device to bypass the series current to the remaining circuit elements in the case of a defective lamp or connection.

Operation of the bypass device is controlled within the socket with operational parameters controlled either from within the socket or in conjunction with an external element in the lamp. The operation of the bypass circuit is latching, that is once operating the bypass will continue to operate until reset preventing unwanted flicker in the case of intermittent connections.

The method of resetting the bypass circuit may be either manual or automatic. The socket bypass may also contain a time delay to allow internal bypass circuits that may be included within the lamp to operate before the socket bypass activates.

BRIEF DESCRIPTION OF THE DRAWINGS

The accompanying drawings, which are incorporated herein and form a part of the specification, illustrate the present invention and, together with the description, further serve to explain the principles of the invention and to enable a person skilled in the pertinent art to make and use the invention.

DETAILED DESCRIPTION OF THE INVENTION

Figure 1:
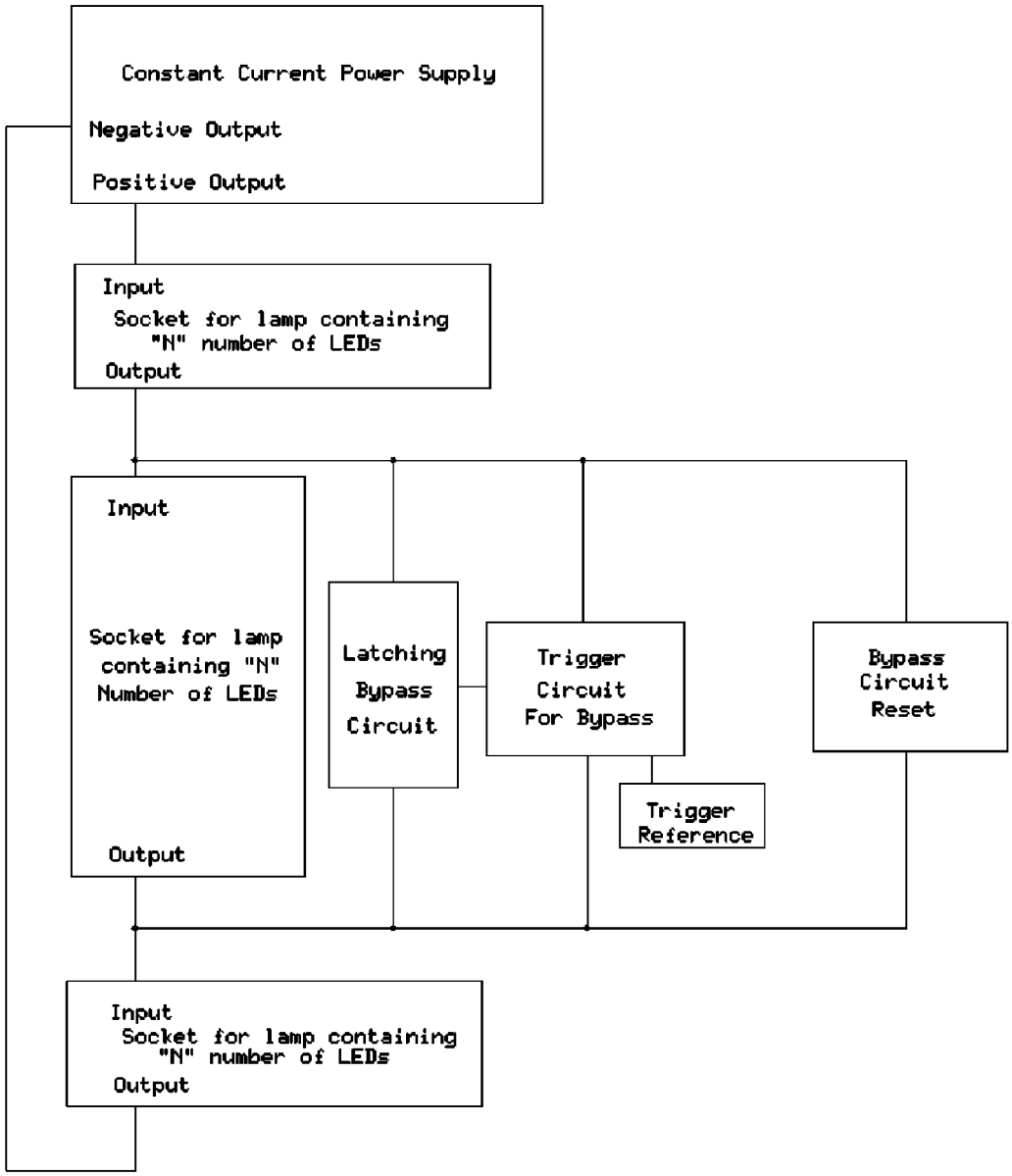
FIG. 1 is a block drawing illustrating a typical configuration in which the socket would be used.

In the following detailed description of the invention of exemplary embodiments of the invention, reference is made to the accompanying drawings (where like numbers represent like elements), which form a part hereof, and in which is shown by way of illustration specific exemplary embodiments in which the invention may be practiced. These embodiments are described in sufficient detail to enable those skilled in the art to practice the invention, but other embodiments may be utilized and logical, mechanical, electrical, and other changes may be made without departing from the scope of the present invention. The following detailed description is, therefore, not to be taken in a limiting sense, and the scope of the present invention is defined only by the appended claims.

In the following description, numerous specific details are set forth to provide a thorough understanding of the invention. However, it is understood that the invention may be practiced without these specific details. In other instances, well-known structures and techniques known to one of ordinary skill in the art have not been shown in detail in order not to obscure the invention. Referring to the figures, it is possible to see the various major elements constituting the apparatus of the present invention.

The present invention is a light socket for series LED lighting and a method for the most cost effective and efficient use of LEDs in general lighting applications. In a general configuration, the LEDs should be used in a series configuration. Series operation results in the highest efficiency and the best match to existing power sources. Series operation significantly reduces wiring costs.

Power supplies that drive the LEDs should utilize a constant current configuration for consistent light output and protection against voltage fluctuations. Since LEDs are basically current actuated devices, using all of the devices in series and controlling the current flowing through them results in the most consistent and efficient light output. Constant current operation of power supplies allows for simple and inexpensive implementation of bypass circuits to protect against total string failure. Power supplies provide for external control of the value of the current through the LED string to provide a dimming function. Power supplies provide drive current to the LEDs that is electrically isolated from mains supplies. Since LED strings operate below the maximum voltage levels specified in most building codes that define low voltage circuits, isolation from the mains will allow significantly relaxed wiring requirements with commensurate cost savings.

Series connected LEDs in general lighting situations should have separate wiring to take advantage of the characteristics and potential cost savings of the technology. Current lighting practices for parallel lighting require two wires to run between each fixture. With series operation, only one wire is required between each fixture that with proper layout practices will cut wire cost almost in half. LED strings will generally have a current value of below 1 ampere. The resulting much smaller wire gauges required will result in a cost reduction of approximately 90%. The low voltage applied to most strings will further reduce wiring costs because they will be classified as low voltage circuits. However, this invention may be used with non-isolated power supplies of any voltage level commensurate with applicable electrical codes.

The lamp socket of the present invention should be of universal design to allow for a variety of lamp types to be utilized. The socket should contain a minimum of two electrical connections for passage of the main LED current plus any other contacts as needed for "smart" functions including bypass initiation level and reset. The socket should contain a bypass function to shunt string current in case of a defective lamp or connection. Internal lamp bypass circuits do not address the condition of a bad external connection. The bypass function should be of a latching configuration so that once it is initiated it will remain on until reset. This will eliminate annoying flickering if the lamp or connection is intermittent. The socket should provide a method of manually or automatically resetting the bypass function.

The bypass function should have a means, either manual or automatic, to set the initiation point allowing for proper operation with lamps containing different numbers of LEDs that might be used with the socket. The bypass function should have a time delay to allow any in lamp bypass circuits that may be present to activate first. For example if a particular lamp contained 10 LEDs in series, each having a bypass circuit, failure of one LED should trigger the internal bypass for that one LED before the socket circuit bypasses the entire lamp. The lamp would then function with 9 of the 10 LEDs operational which may be an acceptable condition. The bypass function should provide immunity to false triggering.

In addition to containing the appropriate numbers and types of LEDs in a form appropriate for the intended application the lamp contain functions to interface with the socket. A method to automatically reset the socket bypass circuit during the process of re-lamping thus eliminating the need to manually reset the socket for operation with the new lamp is taught. A method to indicate to the socket the normal forward operating voltage of the lamp allowing an automatic setting of the proper trip point by the socket bypass circuit is taught. The lamp should allow either manual or automatic determination of the trip information value during manufacturing that will later be sent to the socket is also taught.

The manufacturing process for the lamp reads the normal operating parameters of the lamp and automatically sets the information in the lamp that will transfer to the socket bypass circuit upon their connection.

Now referring to FIG. 1, the block diagram shows a typical configuration in which the socket would be used. For brevity, only one of the sockets in the chain is drawn with the elements taught by the present invention. However, it would be necessary for all sockets in the chain to have the circuit elements for the string to function properly. All the advantages of this configuration would be realized only if all the LEDs and sockets were wired in a series arrangement.

One advantage of this socket is that any number of LEDs in a series arrangement could be used with the manual or automatic trigger reference providing proper operation even if power supplies with different maximum output voltage were used. Any number of LEDs in any sockets could be used up to the limits of the power supply giving the user great flexibility in lighting arrangements.

FIG. 1 denotes, separately, the functional elements of the bypass circuit, the trigger circuit, the trigger reference, and the reset circuit. A constant current power supply with both a negative and positive output provides input to the first lamp/socket containing one or more LEDs. That socket output is then the input for the next socket in the string. The lamp voltage in each socket also interacts with a latching bypass circuit, trigger circuit for bypass with a trigger reference, and bypass circuit reset. The output of each socket serves as input to any remaining sockets in a series fashion before it is returned in a loop system to the power supply.

Figure 2A:
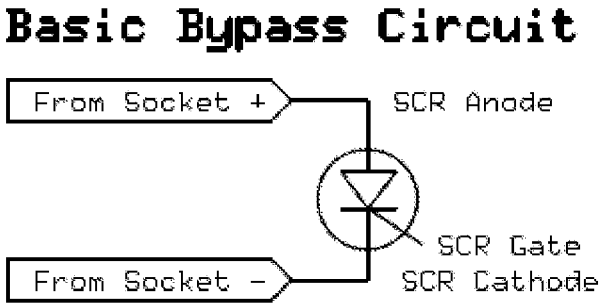
FIG. 2*a* is a basic bypass circuit.
Figure 2B:
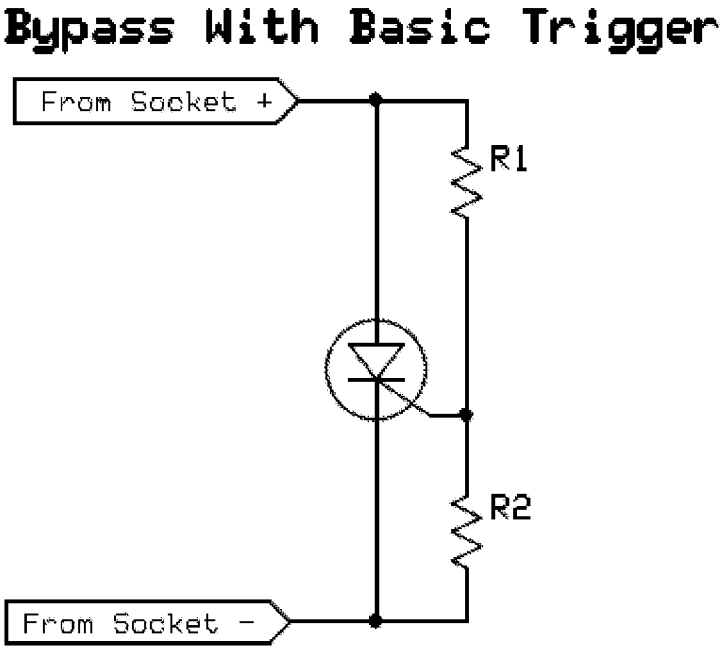
FIG. 2*b* is a bypass circuit with a basic trigger.
Figure 2C:
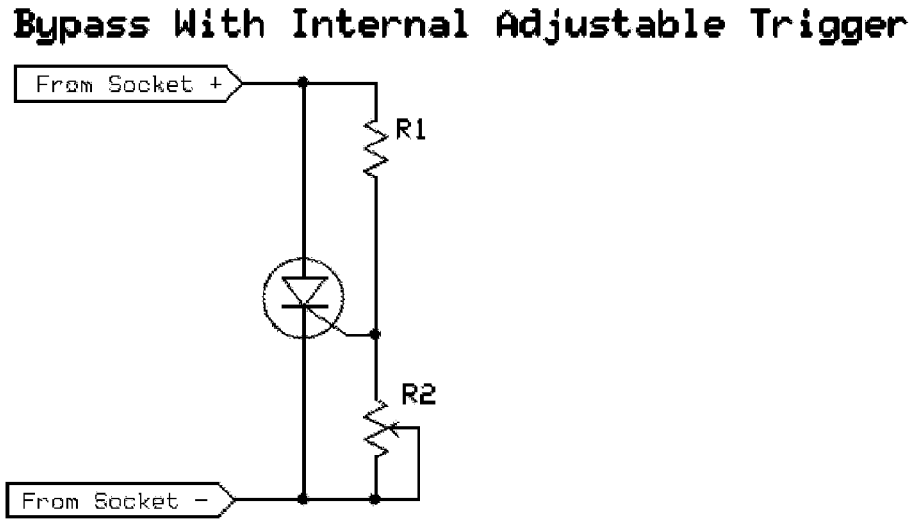
FIG. 2*c* is a bypass circuit with an internal adjustable trigger.
Figure 2D:
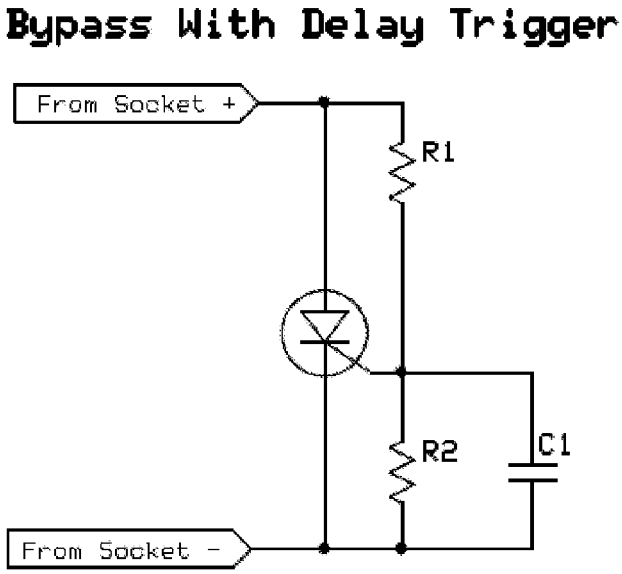
FIG. 2*d* is a bypass circuit with a delay trigger.
Figure 2E:
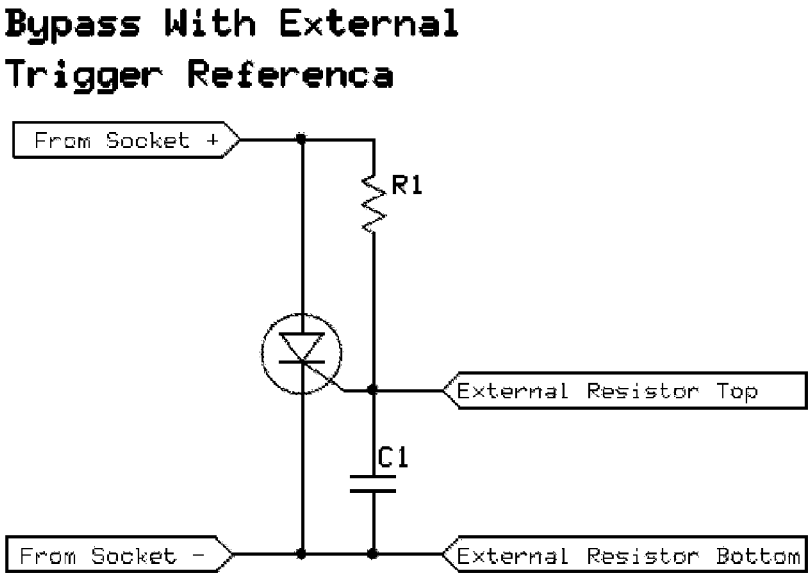
FIG. 2*e* is a bypass circuit with an external trigger reference.
Figure 2F:
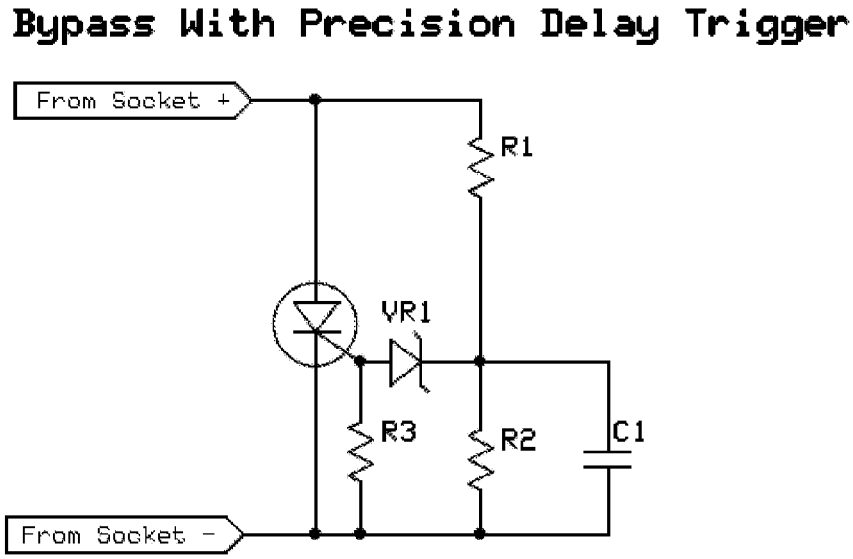
FIG. 2*f* is a bypass circuit with a precision delay trigger.

The present invention teaches a bypass circuit in FIG. 2*a* and several alternative embodiments of the bypass circuit in combination with a trigger circuit in FIGS. 2*b*-2*f*. It is important to note that for FIGS. 2*a*-2*f*, only a Silicon Controlled Rectifier (SCR) as the primary active element is shown as it is probably the best choice. However there are other ways to achieve a latching bypass and the design should not be limited to an SCR.

FIGS. 2*b*-2*f* show the variable element always connected between the gate and cathode of the SCR, but it could also be between the anode and gate of the SCR. The arrangement shown is the best because any problem with the variable element will cause the bypass to trigger resulting in current continuing to flow in the rest of the chain. In other words, if the circuit fails only the lamp in the defective socket would be extinguished and the problem would be immediately visible. In the other arrangement, if the socket had a defective variable element the bypass would not trigger and a bad bulb or bad connection would result in failure of the string. The other problem is that in that case the problem would not be immediately visible and would happen at a random and potentially inopportune moment. Locating the problem would also be more difficult because all the lamps in the string would be extinguished. However, either position of the variable element would work.

In addition, other more sophisticated trigger mechanisms could be used including systems that looked for light output from the LEDs when power was applied, but they are more expensive, could be affected by dimming functions, and might be rendered inoperative if for example the lamp in use was a PAR type with very little light reaching the socket. It is also important to note that various combinations of the trigger circuit elements could be used and are not limited to those shown.

It is interesting to note that if an external element in the lamp is used as a reference, it can be automatically trimmed for proper operation during the lamp manufacturing process by either electrical or optical means. It is also important to note that the variable element is shown on the drawing as a potentiometer but could also be a stepped switch with fixed resistors or any of many other means to create different values of resistance. Also, if the variable element is between the anode and gate, a variable voltage reference could be used but this would be more expensive and have the previously described problems due to the position in the circuit.

Figure 3A:
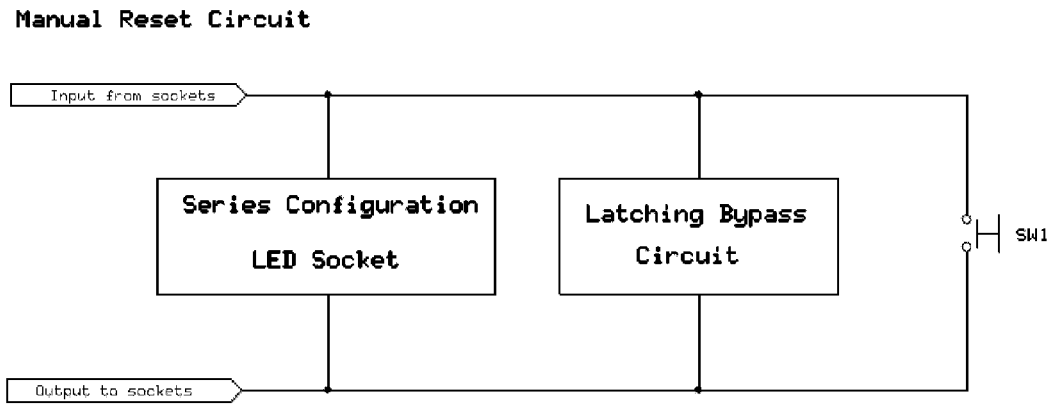
FIG. 3*a* is a manual reset circuit.
Figure 3B:
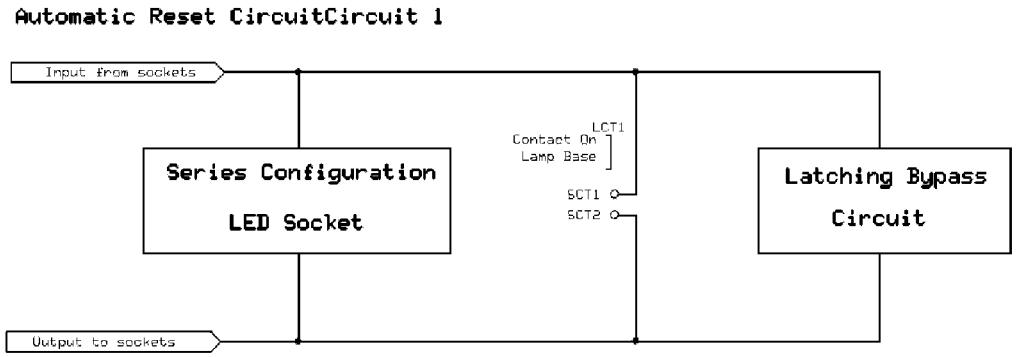
FIG. 3*b* is for a first automatic reset circuit embodiment taught by the present invention.
Figure 3C:
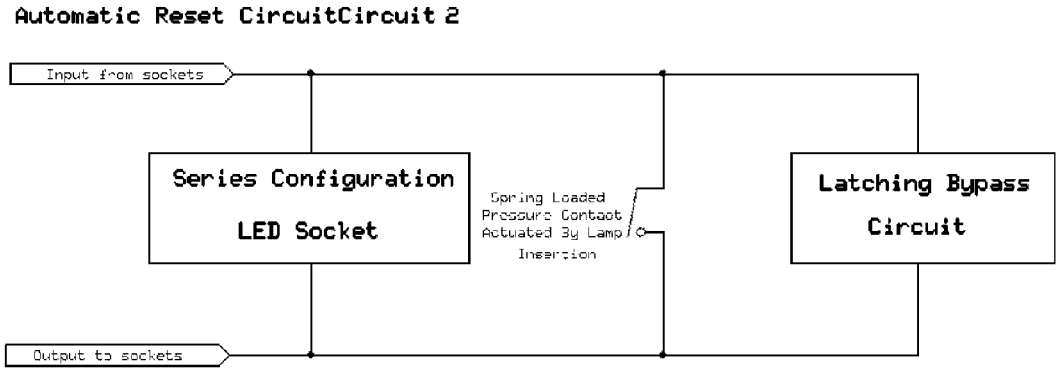
FIG. 3*c* is for a second automatic reset circuit embodiment taught by the present invention.

Now referring to FIGS. 3*a*-3*c* reset circuits are shown being used in combination with the socket and bypass circuits taught by the present invention. Although the use of a reset circuit is not required for the enablement and functionality of the present invention, this second embodiment may incorporate it to include additional features. If people followed best practices and turned power off during re-lamping, the latching bypass circuit would reset itself. However, as we know most people don't do that because of the inconvenience of turning off a remote switch and trying to change a lamp in the dark. In an industrial setting it would be even more of a problem because critical operations in another area could be affected by requiring a shutdown of the whole string.

Now referring to FIG. 3*a*, the manual reset is just a momentary contact, normally open push button switch. After the new lamp is installed, the button is pushed for just a second and then released. The switch diverts the holding current from the bypass circuit enabling the SCR or other control device to reset. If the new lamp and the connections are good the bypass will not re-trigger and lamp operation will be normal.

Now referring to FIGS. 3*b* and 3*c*, the automatic reset uses any of a number of possible configurations to shunt the SCR current after contact with the new lamp is made but before the lamp is in the fully seated position. FIGS. 3*b* and 3*c* show two examples of the many possibilities. The first, as shown in FIG. 3*b*, is a wiping contact on the lamp base that temporarily bypasses current from the latching device during insertion but travels past the contacts when the lamp is fully inserted removing the bypass around the SCR and allowing normal operation. The second, as shown in FIG. 3*c*, is a spring loaded pressure contact that closes after contact is made with the lamp but before it is fully seated. Upon full seating, the pressure on the spring contact is released allowing it to open the circuit for normal operation.

It is also important to note that the present invention is present in a single channel within the socket embodiment, but is also adaptable to a multiple-channel socket. The present invention can function on any socket, any lamp, and any number of LEDs. The present inventions does not require a separate socket for every configuration, which makes it more flexible than other related prior art devices. The present invention teaches a flexible socket for use with a plurality of LEDs, not a specific socket. Additionally, the present invention teaches where the application of the invention to a single channel is the same as the application to RGB multiple outlets, i.e. one to a plurality of channels.

Thus, it is appreciated that the optimum dimensional relationships for the parts of the invention, to include variation in size, materials, shape, form, function, and manner of operation, assembly and use, are deemed readily apparent and obvious to one of ordinary skill in the art, and all equivalent relationships to those illustrated in the drawings and described in the above description are intended to be encompassed by the present invention.

Furthermore, other areas of art may benefit from this method and adjustments to the design are anticipated. Thus, the scope of the invention should be determined by the appended claims and their legal equivalents, rather than by the examples given.

The embodiments of the invention in which an exclusive property or privilege is claimed are defined as follows:

1. A light socket for Series LED Lighting comprising:
electrical and mechanical connection for a series connected LED lamp to an appropriate electrical circuit;
additional series connected light producing elements;
a bypass device connected to the remaining circuit elements in the case of a defective lamp or connection;
operation of the bypass device is controlled within the socket with operational parameters controlled either from within the socket or in conjunction with an external element in the lamp;
the operation of the bypass device is latching, once operating the bypass will continue to operate until reset preventing unwanted flicker in the case of intermittent connections; and
the bypass device is reset either manually or automatically.

2. The device of claim 1, wherein the light socket bypass device further comprises a time delay to allow internal bypass circuits included within the lamp to operate before the socket bypass activates.

3. The device of claim 2, further comprising
a reset circuit
manually or automatically resetting the bypass function.

4. The device of claim 3, further comprising
two or more electrical connections for passage of the main LED current plus any other contacts as needed for additional functions including bypass initiation level and reset.

5. The device of claim 2, further comprising
an internal lamp bypass function to shunt string current in case of a defective lamp or connection.

6. The device of claim 5, further comprising
a latching configuration of the internal lamp bypass circuits wherein once the internal lamp bypass circuit is initiated the internal lamp bypass circuit will remain on until reset.

7. The device of claim 6, wherein the bypass function has a manual or automatic function, to set the initiation point allowing for proper operation with lamps containing different numbers of LEDs.

8. The device of claim 7, wherein the bypass function has a time delay to allow any in lamp bypass circuits to activate first.

9. The device of claim 1, further comprising
automatically resetting the socket bypass circuit during the process of re-lamping thus eliminating the need to manually reset the socket for operation with the new lamp is taught;
indicating to the socket the normal forward operating voltage of the lamp allowing an automatic setting of the proper trip point by the socket bypass circuit is taught; and
allowing either manual or automatic determination of the trip information value during manufacturing that will later be sent to the socket; and
the normal operating parameters of the lamp are set in the lamp during the manufacturing process and then transfer to the socket bypass circuit.

10. A light socket for Series LED Lighting comprising:
a string of two or more sockets each containing a bypass circuit and lamp, each lamp containing one or more LEDs;
a constant current power supply with both a negative and positive output providing input to a first socket containing a bypass circuit and lamp with the lamp containing one or more LEDs;
the output of each socket serves as input to any remaining sockets in a series fashion before it is returned in a loop system to the power supply;
a latching bypass circuit;
a trigger circuit;
a trigger reference;
a reset circuit; and
the lamp voltage in each socket interacts with the latching bypass circuit and the trigger circuit creating a bypass with a trigger reference and a bypass circuit reset.

11. The device of claim 10, further comprising
a Silicon Controlled Rectifier (SCR).

12. The device of claim 11, further comprising
the SCR in combination with a basic trigger circuit; and
wherein a variable element is connected between the gate and cathode of the SCR, or between the anode and gate of the SCR.

13. The device of claim 12, wherein the variable element is a potentiometer or a stepped switch with fixed resistors.

14. The device of claim 12, further comprising an internal adjustable trigger.

15. The device of claim 14, further comprising a precision delay trigger.

16. The device of claim 15, further comprising in combination
an external trigger reference, wherein if an external element in the lamp is used as a reference, it can be automatically trimmed for proper operation during the lamp manufacturing process by either electrical or optical means.

17. The device of claim 11, further comprising in combination
a manual reset which is just a momentary contact, normally open push button switch.

18. The device of claim 11, further comprising in combination
one or more wiping contacts on the lamp base that temporarily bypasses current from the latching device during insertion but travels past the contacts when the lamp is fully inserted removing the bypass around the SCR and allowing normal operation.

19. The device of claim 11, further comprising in combination
a spring loaded pressure contact that closes after contact is made with the lamp but before it is fully seated; and
upon full seating, the pressure on the spring contact is released allowing it to open the circuit for normal operation.

* * * * *